US007588473B2

(12) United States Patent
Beachy Head

(10) Patent No.: US 7,588,473 B2
(45) Date of Patent: Sep. 15, 2009

(54) MARINE DRIVE

(76) Inventor: Michael Alan Beachy Head, 11 Upper Thistle St., Fernwood, Cape Town (ZA) 7700

( * ) Notice: Subject to any disclaimer, the term of this patent is extended or adjusted under 35 U.S.C. 154(b) by 7 days.

(21) Appl. No.: 11/814,259

(22) PCT Filed: Feb. 20, 2006

(86) PCT No.: PCT/ZA2006/000027

§ 371 (c)(1),
(2), (4) Date: Jul. 18, 2007

(87) PCT Pub. No.: WO2006/089316

PCT Pub. Date: Aug. 24, 2006

(65) Prior Publication Data

US 2008/0045094 A1 Feb. 21, 2008

(30) Foreign Application Priority Data

Feb. 18, 2005 (ZA) ..... 05/1448
Nov. 2, 2005 (ZA) ..... 05/8874

(51) Int. Cl.
*B63H 5/20* (2006.01)
*B63H 5/125* (2006.01)
*B63H 20/08* (2006.01)

(52) U.S. Cl. ..... 440/53

(58) Field of Classification Search ..... 440/53
See application file for complete search history.

(56) References Cited

U.S. PATENT DOCUMENTS 2,410,609 A 11/1946 Pecker
2,659,444 A 11/1953 Stanley
2,917,019 A 12/1959 Krueger
3,028,292 A 4/1962 Hinds
3,093,105 A 6/1963 Rebikoff
3,166,040 A 1/1965 Armantrout et al.

(Continued)

FOREIGN PATENT DOCUMENTS

EP 0723910 7/1996

(Continued)

OTHER PUBLICATIONS

Michael Van Rooij, Primary Examiner for the Patent Division, European Patent Office, Communication Pursuant to Article 94(3), Jul. 25, 2008, 13 pages, International Application No. 06 740 976.3-1254, Rijswijk Netherlands.

*Primary Examiner*—Lars A Olson
*Assistant Examiner*—Daniel V Venne
(74) *Attorney, Agent, or Firm*—Haynes and Boone, LLP

(57) ABSTRACT

A stern drive for a boat is provided, which comprises an outer structure that is attachable to the stern of a boat, a housing supported in the outer structure, a gear set and reversing clutch inside the housing, said gear set including a pinion that is rotatable about a transverse axis and an output shaft that extends downwardly within a fairing. The housing is rotatable within the outer structure for steering purposes and the fairing and output shaft are rotatable about the transverse axis of said pinion thereby to permit raising, lowering and trimming of the fairing. The clutch includes a selector rod extending along a central passage defined within a transverse shaft, with selector pins extending radially outwardly into a clutch element.

21 Claims, 12 Drawing Sheets

U.S. PATENT DOCUMENTS 3,175,530 A 3/1965 Petterson
3,229,935 A 1/1966 Bellanca
3,269,497 A 8/1966 Bergstedt
3,382,839 A 5/1968 Kiekhaefer
3,447,504 A 6/1969 Shimanckas
3,452,704 A 7/1969 Watkins
3,478,620 A 11/1969 Shimanckas
3,505,894 A 4/1970 Halibrand
3,520,272 A 7/1970 Ellzey
3,577,953 A 5/1971 Braun et al.
3,583,357 A 6/1971 Shimanckas
3,626,467 A 12/1971 Mazziotti
3,765,370 A 10/1973 Shimanckas
3,768,922 A 10/1973 Dixon
RE27,826 E 12/1973 Langley
3,779,487 A 12/1973 Ashton et al.
3,847,108 A 11/1974 Shimanckas
3,923,131 A 12/1975 La Follette
3,939,795 A 2/1976 Rocka
3,946,698 A 3/1976 LaFollette et al.
3,946,841 A 3/1976 LaFollette et al.
3,955,526 A 5/1976 Kusche
3,977,356 A 8/1976 Kroll
3,999,502 A 12/1976 Mayer
4,037,558 A 7/1977 Nossiter
4,041,840 A 8/1977 Zirps
4,050,359 A 9/1977 Mayer
4,086,869 A 5/1978 Woodruff
4,244,454 A 1/1981 Bankstahl
4,257,506 A 3/1981 Bankstahl
4,276,034 A 6/1981 Kashmerick
4,297,097 A 10/1981 Kiekhaefer
4,308,018 A 12/1981 Nakamura et al.
4,363,629 A 12/1982 Hall et al.
4,375,181 A 3/1983 Conway
4,397,198 A 8/1983 Borgersen et al.
4,408,994 A 10/1983 Blanchard
4,416,637 A 11/1983 Kashmerick et al.
4,493,659 A 1/1985 Iwashita
4,529,387 A 7/1985 Brandt
4,619,584 A 10/1986 Brandt
4,630,719 A 12/1986 McCormick
4,636,175 A 1/1987 Frazzell et al.
4,666,412 A 5/1987 Rawlings
4,679,682 A 7/1987 Gray, Jr. et al.
4,741,670 A 5/1988 Brandt
4,784,625 A 11/1988 Nakahama
4,850,911 A 7/1989 Nakahama et al.
4,869,121 A 9/1989 Meisenburg
4,869,693 A 9/1989 Curtis et al.
4,871,334 A 10/1989 McCormick
4,932,907 A 6/1990 Newman et al.
4,950,188 A 8/1990 Bland et al.
4,954,109 A 9/1990 McMorries, IV
4,959,033 A 9/1990 Bland et al.
4,972,809 A 11/1990 Hirasawa
5,006,084 A 4/1991 Handa
5,006,085 A 4/1991 Bland et al.
5,009,621 A 4/1991 Bankstahl et al.
5,024,639 A 6/1991 Crispo
5,035,664 A 7/1991 Bland et al.
5,056,451 A 10/1991 Howlett
5,059,163 A 10/1991 von Greyerz
5,094,081 A 3/1992 Osborne
5,096,034 A 3/1992 Foster
5,108,325 A 4/1992 Livingston et al.
RE34,011 E 7/1992 Brandt
5,171,177 A 12/1992 Hubbell
5,374,207 A 12/1994 Lindberg
5,407,372 A 4/1995 Mondek et al.
5,425,663 A 6/1995 Meisenburg et al.
5,462,463 A 10/1995 Meisenburg et al.
5,476,164 A 12/1995 Moore et al.
5,487,687 A 1/1996 Idzikowski et al.
5,509,323 A 4/1996 Hallenstvedt et al.
5,509,863 A 4/1996 Mansson et al.
5,514,014 A 5/1996 Ogino et al.
5,584,225 A 12/1996 Arvidsson et al.
5,597,334 A 1/1997 Ogino
5,709,128 A 1/1998 Skyman
5,715,728 A 2/1998 Hallenstvedt et al.
5,716,247 A 2/1998 Ogino
5,766,047 A 6/1998 Alexander, Jr. et al.
5,766,048 A 6/1998 Iwashita
5,791,950 A 8/1998 Weronke et al.
5,795,200 A 8/1998 Larkin
5,800,223 A 9/1998 Iriono et al.
5,829,564 A 11/1998 Meisenburg et al.
5,879,210 A 3/1999 Goto et al.
5,890,938 A 4/1999 Eick et al.
5,961,358 A 10/1999 Hardesty et al.
5,964,626 A 10/1999 Varney et al.
6,062,360 A 5/2000 Shields
6,176,170 B1 1/2001 Uppgard et al.
6,176,751 B1 1/2001 Takahashi
6,186,845 B1 2/2001 Head
6,361,387 B1 3/2002 Clarkson
6,439,937 B1 8/2002 Mansson et al.
6,468,119 B1 10/2002 Hasl et al.
6,468,120 B1 10/2002 Hasl et al.
6,478,641 B2 11/2002 Jordan
6,523,655 B1 2/2003 Behara
6,599,159 B1 7/2003 Hedlund et al.
6,609,939 B1 8/2003 Towner et al.
6,755,703 B1 6/2004 Erickson
6,834,751 B1 12/2004 Magee
6,837,761 B2 1/2005 Saito
6,902,451 B1 6/2005 Theisen
6,960,107 B1 11/2005 Schaub et al.
7,001,230 B2 2/2006 Saito
7,128,625 B2 10/2006 Saito
7,153,101 B2 12/2006 Mansson
2006/0240722 A1 10/2006 Kubinski

FOREIGN PATENT DOCUMENTS

WO 2004/085245 10/2004

MARINE DRIVE

This application is being filed pursuant to 35 USC §371 as a national stage filing of PCT/ZA2006/000027 filed on 20 Feb. 2006, which claims priority from South African Patent Application No. 2005/01448 filed 18 Feb. 2005 and South African Patent Application No. 2005/08874 filed 2 Nov. 2005, the entireties of which are incorporated by reference herein.

FIELD OF THE INVENTION

THIS INVENTION relates to marine drives.

BACKGROUND OF THE INVENTION

Marine drives can conveniently be classified into three categories.

These are:

(i) Inboard motors;

(ii) Outboard motors;

(iii) Stern drives.

Inboard motors and outboard motors are discussed in the preamble of U.S. Pat. No. 6,186,845 which discloses an embodiment of the type of drive known as a stern drive. In this type of drive the motor is mounted on or immediately inboard of the transom of the boat with its drive shaft passing through the transom and downwards within a fairing outside the boat's hull to the gear set and propeller shaft which are at the lower end of the fairing.

A technical complexity which has to be dealt with in a stern drive results from two factors. Firstly, the fairing must be able rotate about a vertical, or substantially vertical, axis so as to direct the propeller's thrust at an angle to the front-to-rear line thereby to permit steering. Secondly, it must be possible to "trim" the fairing, which means tilting the fairing about a horizontal axis to change its pitch. This directs the propeller's thrust either horizontally or at a desired angle with respect to horizontal. This movement is also used for the purpose of raising the fairing so that the boat can be loaded on a trailer or run onto a shore.

U.S. Pat. No. 6,186,845 discloses a stern drive which permits the steering motion of the fairing and also the tilting motion of the fairing which is needed to adjust the fairing's pitch and permit it to be raised to enable the boat to be placed on a trailer.

PCT specification WO 2004/085245 discloses another form of stern drive. Without in any way attempting to provide an exhaustive list, other forms of stern drive are disclosed in U.S. Pat. Nos. 6,468,119, 5,601,464, 4,037,558, 3,847,108 and 3,166,040.

Conventional stern drives are based on layouts in which the crank shaft of the engine drives an output shaft through a universal joint, or more usually two universal joints. Constant velocity joints have been proposed as substitutes for universal joints. The output shaft is horizontal, or substantially horizontal, and drives a gear set, the output shaft of which is vertical or substantially vertical. The vertical output shaft drives a lower gear set which in turn drives the propeller shaft.

A gimbel is provided which carries the motor and which is mounted on a fixed part of the boat. The gimbel is usually mounted for motion about a vertical, or near vertical, axis. A steering arm is connected to the gimbel. By rotating the gimbel about its vertical mounting axis, the gimbel and the entire fairing are displaced about the vertical axis of the gimbel thereby directing the thrust of the propeller at an angle to the front-to-rear line of the boat and enabling it to be steered.

The mounting of the fairing on the gimbel is about a generally horizontal axis. By tilting the fairing about this horizontal axis with respect to the gimbel using one or more rams, the fairing can be trimmed up or down and lifted for stowage.

The universal or constant velocity joints provided between the crank shaft and the horizontal output shaft permit these shafts to move relative to one another as the fairing moves with the gimbel (about a vertical steering axis) and with respect to the gimbel (about a horizontal trim axis).

A modification on this standard system has recently become available commercially. In this form the gimbel is mounted on the boat for movement, with the fairing, about a horizontal axis to enable the fairing to be trimmed. The fairing is mounted on the gimbel for movement with respect to the gimbel about a vertical axis. The steering arm displaces the fairing with respect to the gimbel about this vertical axis for steering purposes.

The mounting structure of U.S. Pat. No. 6,186,845 avoids the use of universal joints but has the disadvantage that the entire motor and fairing moves during trimming motion. This means that a space, in addition to that occupied by the motor in its normal position, must be provided and into which space the motor can move when the fairing is raised for stowage purposes.

The gear set of conventional stern drives as described above, can include a first bevel pinion driven from the crank shaft of the motor, first and second bevel gears meshing with the first bevel pinion and being rotated in opposite directions, a reversing clutch for connecting the first bevel gear or the second bevel gear to a first transverse shaft. The first transverse shaft will thus rotate in opposite directions, depending on whether the first or the second bevel gear are connected to it. The rotation of the first transverse shaft is transferred to the output shaft.

The first and second bevel gears are coaxially carried on the first transverse shaft on opposite sides of the first bevel pinion and the clutch is thus used to connect either the first or the second bevel gear to the first transverse shaft in order to change the rotational direction of the output shaft between a forward and a reverse condition. Each of the first and second bevel gears can have a protruding part that defines a conical clutch face and the clutch can include a clutch element, connected to the first transverse shaft with helical splines, between the first and second bevel gears. The clutch element can be connected to either the first or the second bevel gear, by sliding axially on the first transverse shaft and engaging the conical clutch face of one of the bevel gears.

The helical splines are oriented so that, if the clutch element is connected to one of the first or the second bevel gears and transfers torque from the bevel gear to the first transverse shaft, the clutch element is drawn into engagement with the particular bevel gear by the interaction between the clutch element and the splines. The result is that the clutch keeps itself in engagement, while torque is being transferred and little force is required to engage it. However, the force that is required to overcome the self engaging spline action and thus to disengage the clutch, can be quite high. The mechanism by which the clutch element is shifted on the first transverse shaft thus has to be capable of effecting substantial axial forces on the clutch element.

In gear sets of this kind, the clutch is conventionally operated by sliding the clutch element on the first transverse shaft, with a fork-shaped selector, engaging the clutch element in a circumferential shifting groove. However, selectors of this type, that obviously have to be clear of the bevel gears, require space, which comes at a premium in these gear sets and the spacial requirements of these selectors inhibit the development of compact new types of stern drives. It should be borne in mind that the gearset is aft of the transom and the hydrodynamics of the marine drive can be severely affected by the size of the gear set, the gearbox casing, the cylindrical housing, etc.

The main object of the present invention is to provide an improved stern drive, preferably including an improved reversing clutch.

SUMMARY OF THE INVENTION

According to a first aspect of the present invention there is provided a stern drive which comprises:

an outer structure that is attachable to the stern of a boat;

a housing supported in the outer structure;

a gear set and reversing clutch inside the housing, said gear set including a pinion that is rotatable about a transverse axis; and an output shaft that extends downwardly within a fairing;

wherein the housing is rotatable within the outer structure for steering purposes and the fairing and output shaft are rotatable about the transverse axis of said pinion thereby to permit raising, lowering and trimming of the fairing.

The axis of rotation of the housing relative to the outer structure, may extend at an inclined angle.

Said gear set and reversing clutch may comprise:

a first bevel pinion, connectable to a motor;

first and second bevel gears that mesh with the bevel pinion on diametrically opposed sides of the bevel pinion and that are coaxial, each of the bevel gears defining a conical clutch face;

a first transverse shaft passing coaxially through the bevel gears;

a clutch element disposed on the transverse shaft between the bevel gears, said clutch element defining two conical surfaces, each of which is complemental to the clutch face one of the bevel gears;

a helical pinion on said first transverse shaft;

a helical gear meshing with said helical pinion and carried by a second transverse shaft; and a second bevel pinion carried by the second transverse shaft and meshing with a third bevel gear carried by said output shaft, said fairing rotating about the axis of the second transverse shaft.

The fairing may be displaced by a ram the cylinder of which forms part of said housing and the rod of which may be connected to a structure which forms an extension of said fairing.

Said output shaft may drive a pinion which meshes with a gear on a further output shaft that is parallel to the first mentioned output shaft, the output shafts driving co-axial propeller shafts and the arrangement being such that the output shafts rotate in opposite directions and the propeller shafts also contra-rotate.

The stern drive may include a third output shaft, driven from the pinion. E.g. the third output shaft may have a gear that meshes with the pinion or with the gear of the second output shaft.

Said fairing may comprise a pair of side sections which are attached together, and a top section which is attached to the side sections.

The output shaft may be in an elongate casing which extends upwardly from said fairing and which may itself be extended by a pivot structure to which said rod is connected. The pivot structure may be mounted on said second transverse shaft and may rotate about it during lifting and lowering of the fairing and during trimming.

The first transverse shaft may define helical splines with which the clutch element is in engagement and the transverse shaft may define a central passage that extends axially form at least one of its ends and defines at least one internal recess that extends in a radial direction. The stern drive may further include a selector rod, disposed coaxially within the central passage of the transverse shaft and being axially slidable within the central passage and at least one selector pin extending transversely form the selector rod, at least one slot being defined in the transverse shaft, extending from the central passage to the outside of the shaft and having an orientation that is generally aligned with the helical splines of the shaft, the selector pin extending from the selector rod, through the slot and into the internal recess defined in the clutch element.

According to another aspect of the present invention there is provided a stern drive including a gear set and reversing clutch comprising:

a bevel pinion, connectable to an input shaft;

first and second bevel gears that mesh with the bevel pinion on diametrically opposed sides of the bevel pinion and that are coaxial, each of the bevel gears defining a conical clutch face;

a transverse shaft passing coaxially through the bevel gears, said transverse shaft defining helical splines and a central passage that extends axially form at least one of its ends; and a clutch element disposed on the transverse shaft between the bevel gears in engagement with the helical splines, said clutch element defining at least one internal recess, that extends in a radial direction, and said clutch element defining two conical surfaces, each of which is complemental to the clutch face one of the bevel gears;

wherein the reversing clutch includes a selector rod, disposed coaxially within the central passage of the transverse shaft and being axially slidable within the central passage; and at least one selector pin, extending transversely form the selector rod;

at least one slot being defined in the transverse shaft, extending from the central passage to the outside of the shaft and having an orientation that is generally aligned with the helical splines of the shaft, the selector pin extending from the selector rod, through the slot, into the internal recess defined in the clutch element.

The reversing clutch may include two selector pins extending in diametrically opposing directions from the selector rod, each passing through a separate slot and into a separate internal recess of the clutch element.

Each internal recess in the clutch element may extend to an outer circumference of the clutch element and each selector pin may be held captive within its internal recess, by a retaining element such as a circlip.

The clutch may include a diaphragm, connected to a plunger which is configured to effect axial displacement of the selector rod and the diaphragm may be disposed adjacent the end of the transverse shaft from which the central passage extends.

BRIEF DESCRIPTION OF THE DRAWINGS

For a better understanding of the present invention, and to show how the same may be carried into effect, reference will now be made, by way of non-limiting example, to the accompanying drawings in which.

DETAILED DESCRIPTION

Figure 1:
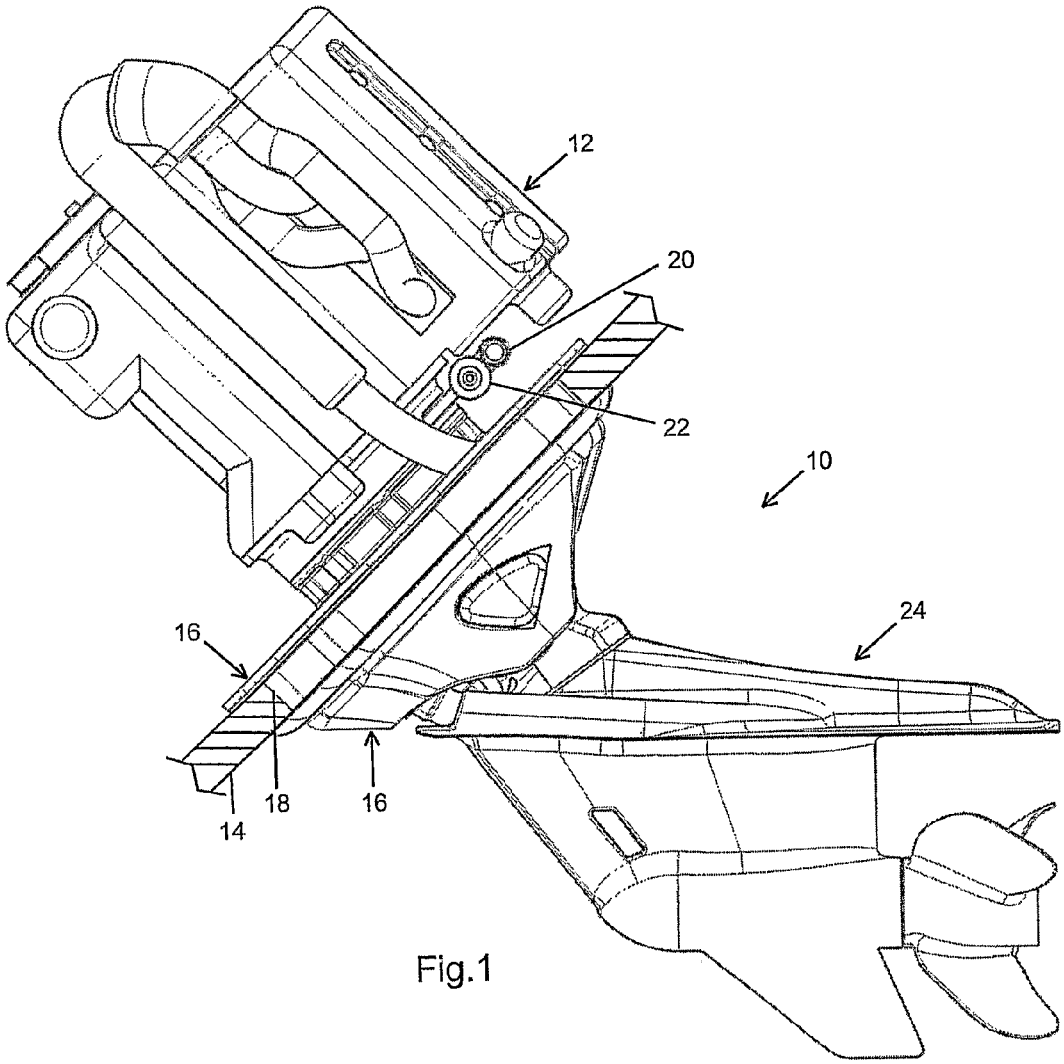
FIG. 1 is a side elevation of a stern drive in accordance with the present invention in its normal running position.
Figure 2:
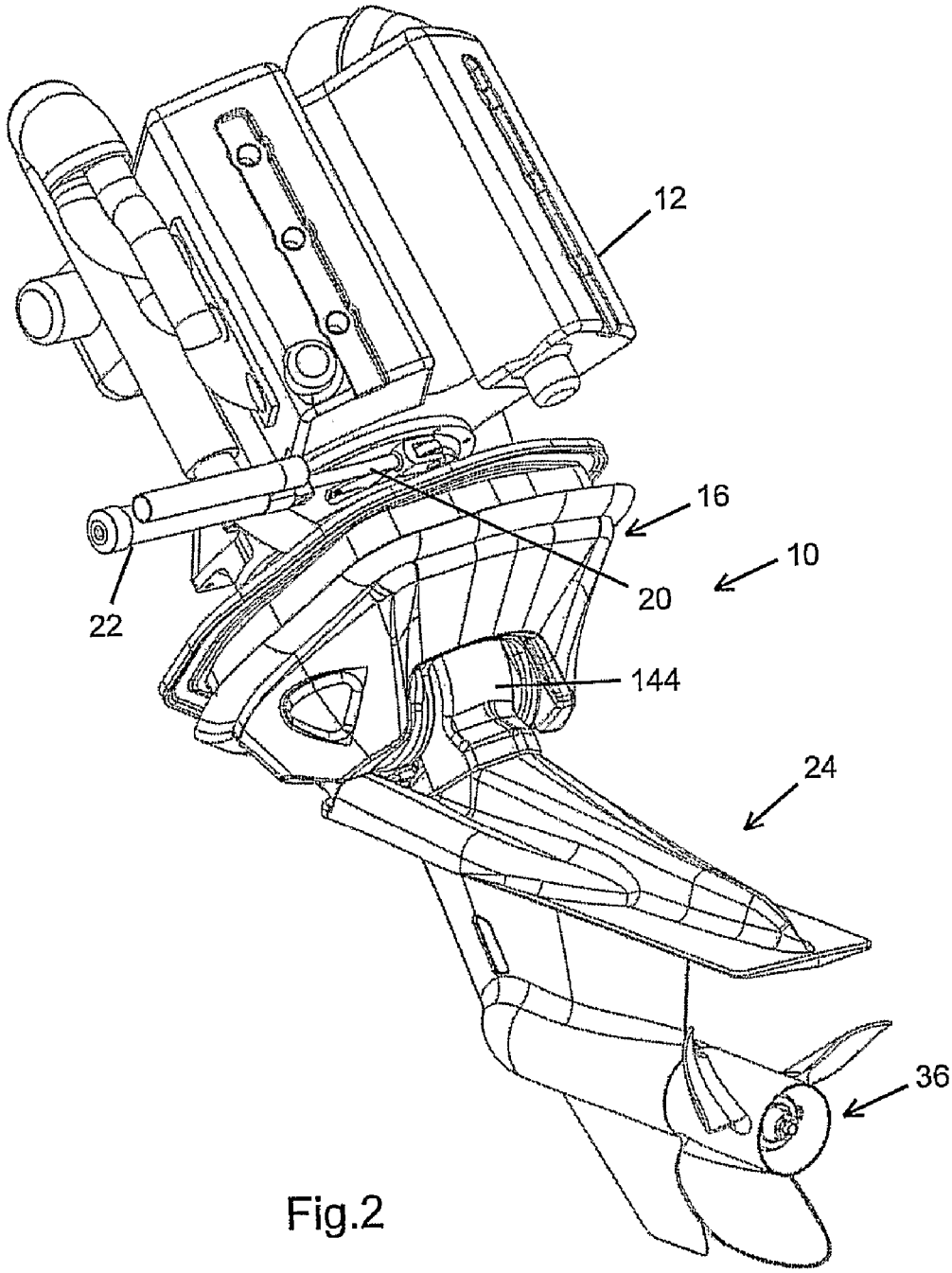
FIG. 2 is a pictorial view from the rear and to one side of the stern drive of FIG. 1.
Figure 3:
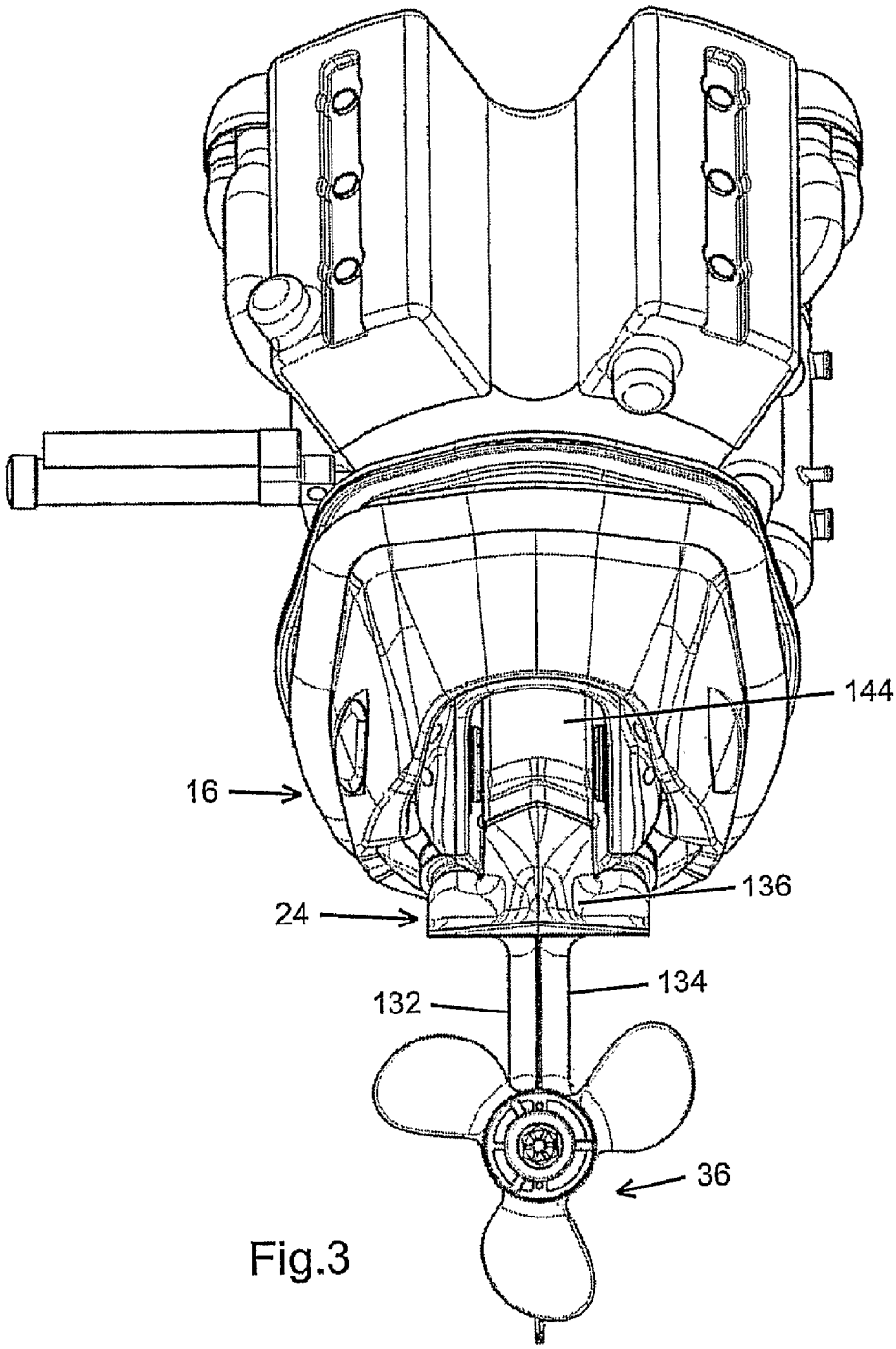
FIG. 3 is a rear elevation of the stern drive of FIGS. 1 and 2.

The stern drive 10 shown in FIGS. 1 to 6 of the drawings comprises a motor 12 which is mounted on the inclined transom 14 of the boat. The structure 16 which mounts the stern drive in an opening 18 provided therefor in the transom 14 is partly within the boat and partly outside the boat.

A steering arm is shown at 20 and the steering cylinder which is connected to the arm is shown at 22.

The fairing of the stern drive is designated 24. It is mounted for pivoting motion about a horizontal axis. It is also mounted for motion about a steering axis as will be described in more detail hereinafter.

There is a bevel gear 26 in the lowermost part of the fairing 24 and a propeller shaft driven by the gear 26 is shown at 28. The shaft 28 passes through a sleeve 30 within which bearings 32 for the shaft 28 are mounted. A further bearing is shown at 34. The propeller is shown at 36 and is secured by a nut 38 to the shaft 28.

The structure 16 is hollow and constructed so that it can house two bearings and seals 40 and 42 which mount a gear set and clutch housing 44. The steering arm 20 is connected to the housing 44 and oscillates the housing 44 for steering purposes as will be described hereinafter.

Figure 5:
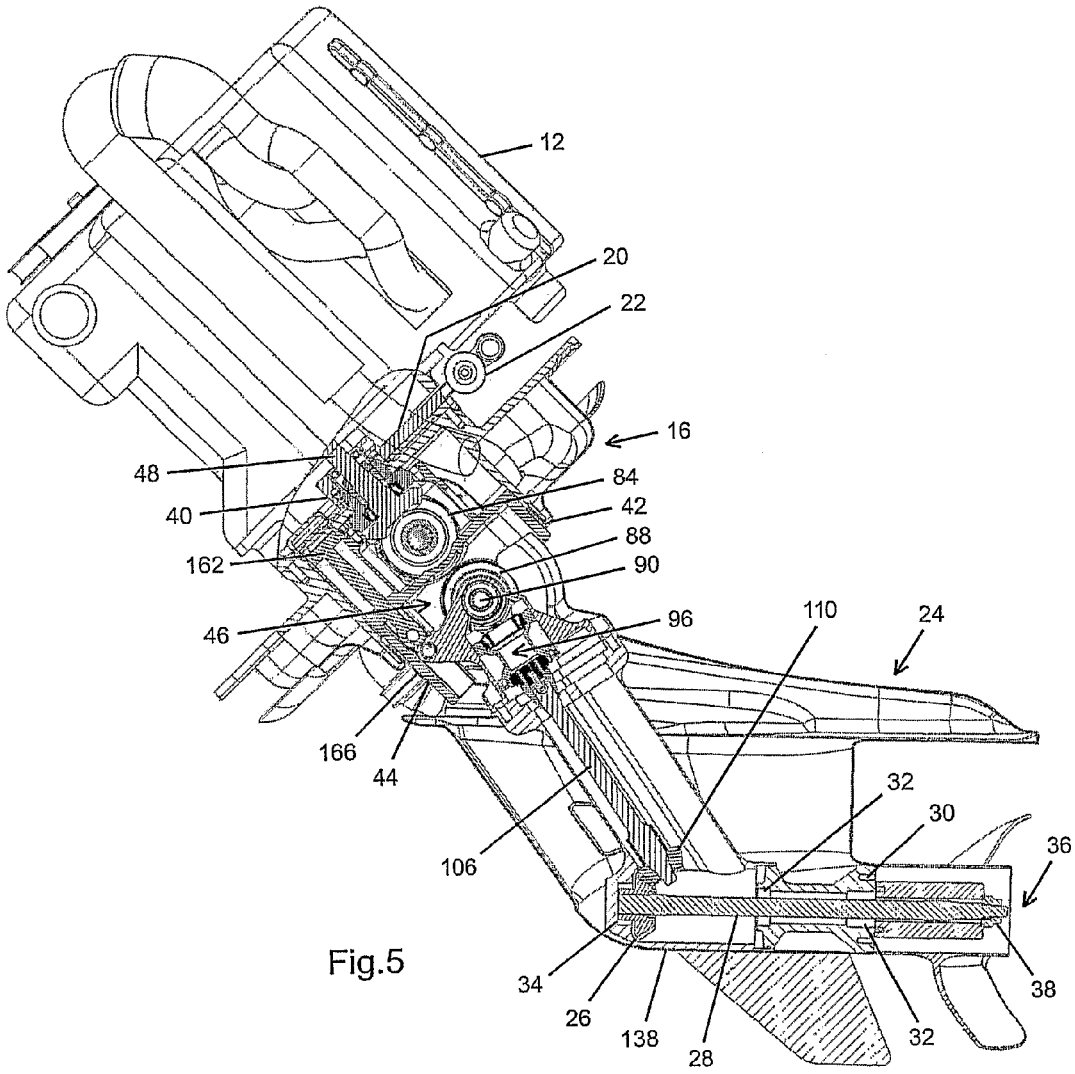
FIG. 5 is a section through the stern drive of FIGS. 1 to 4 in its normal running condition.
Figure 6:
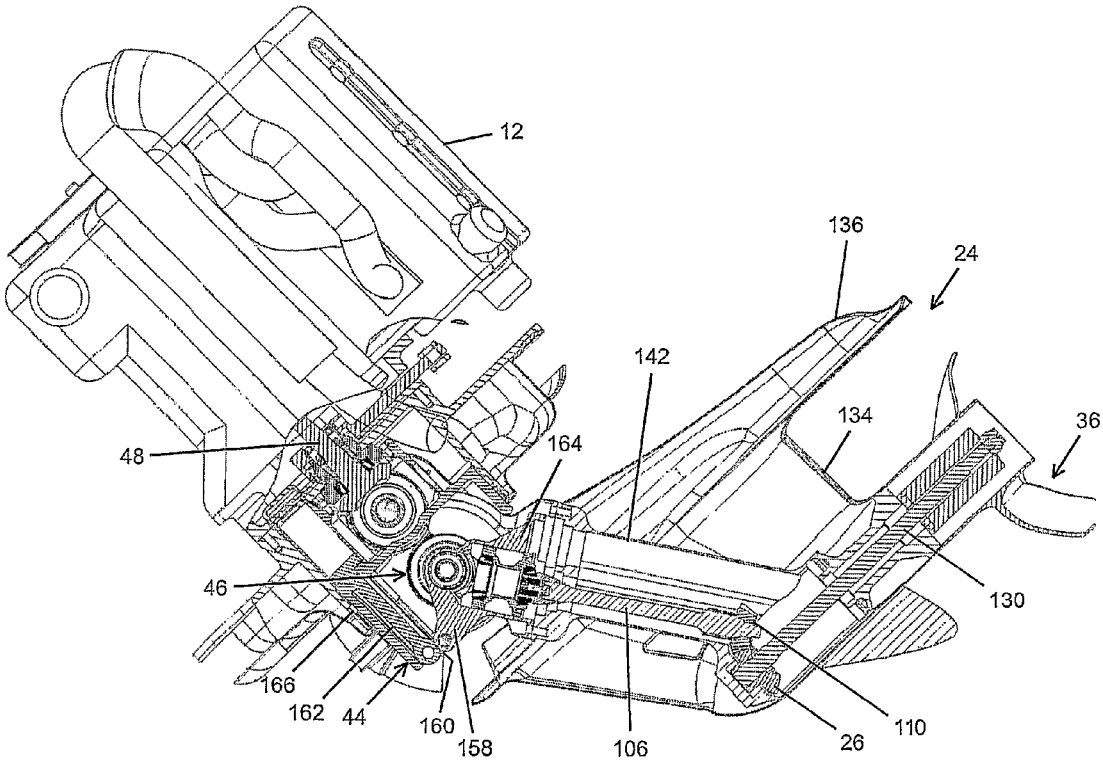
FIG. 6 is a section similar to that of FIG. 5 but showing the fairing of the stern drive raised to its stowed position.
Figure 8:
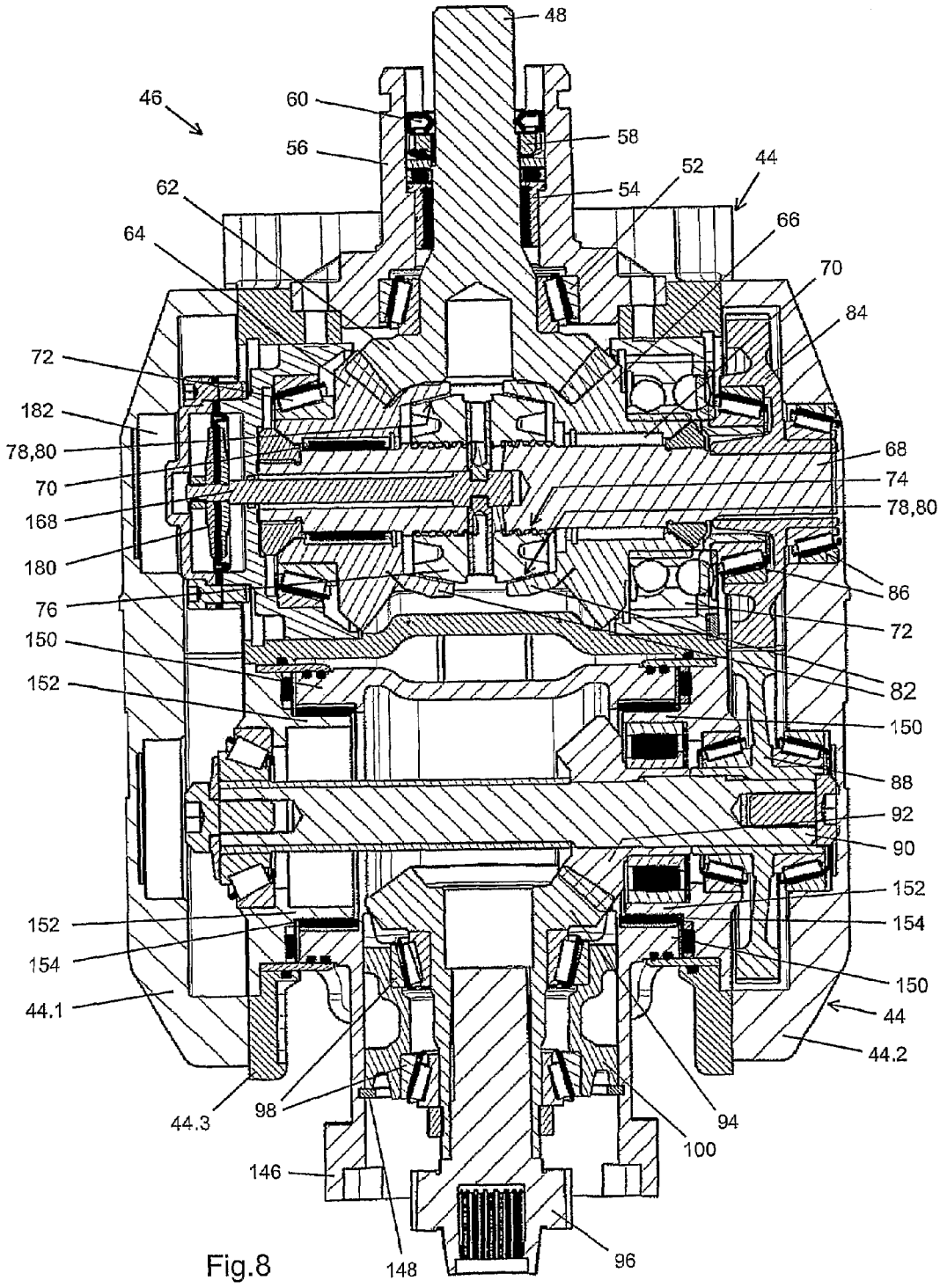
FIG. 8 is a section through a gear set including a reversing clutch in accordance with the present invention.
Figure 10:
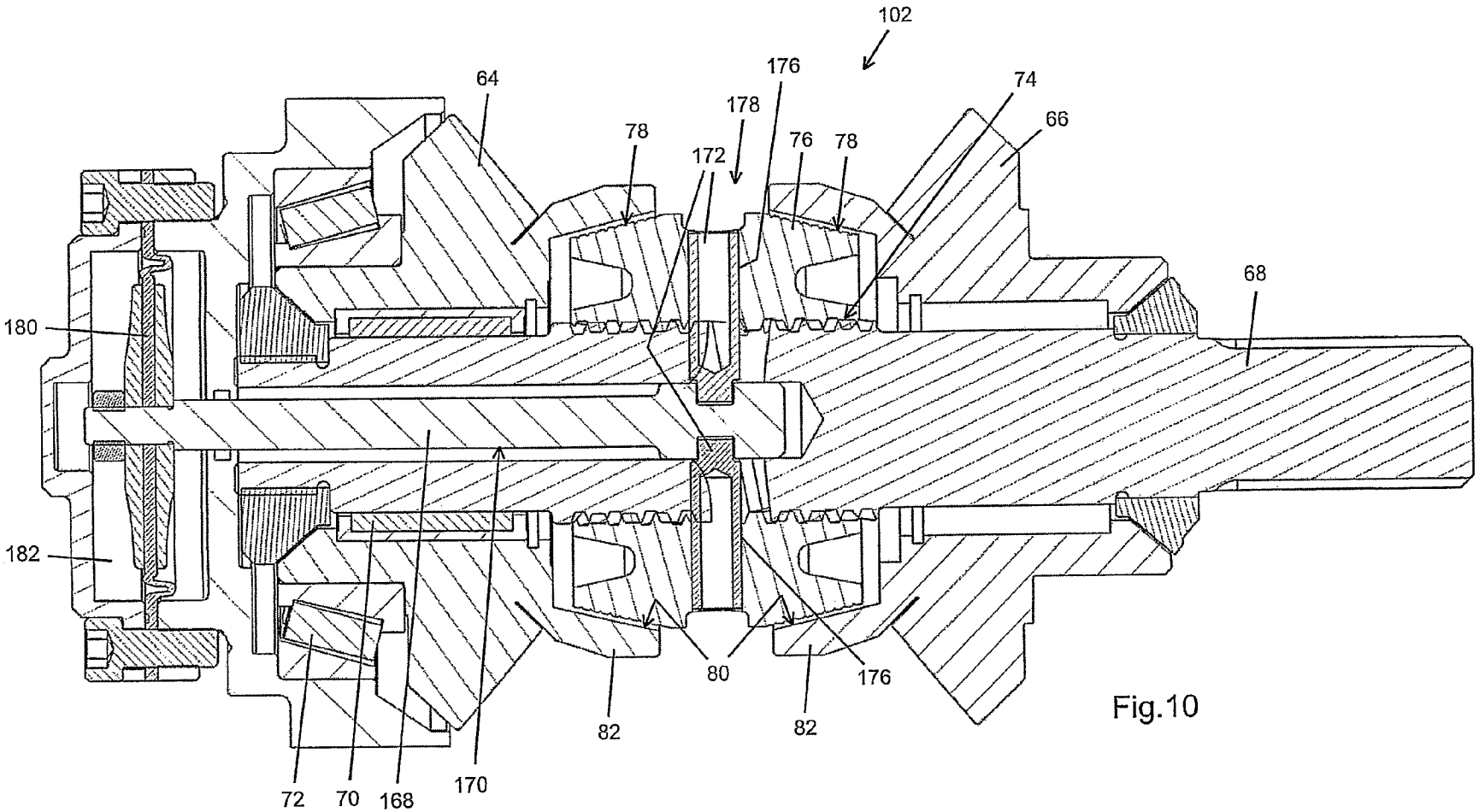
FIG. 10 is a detailed sectional view of the clutch of FIG. 8 (with the first bevel pinion omitted)
Figure 11:
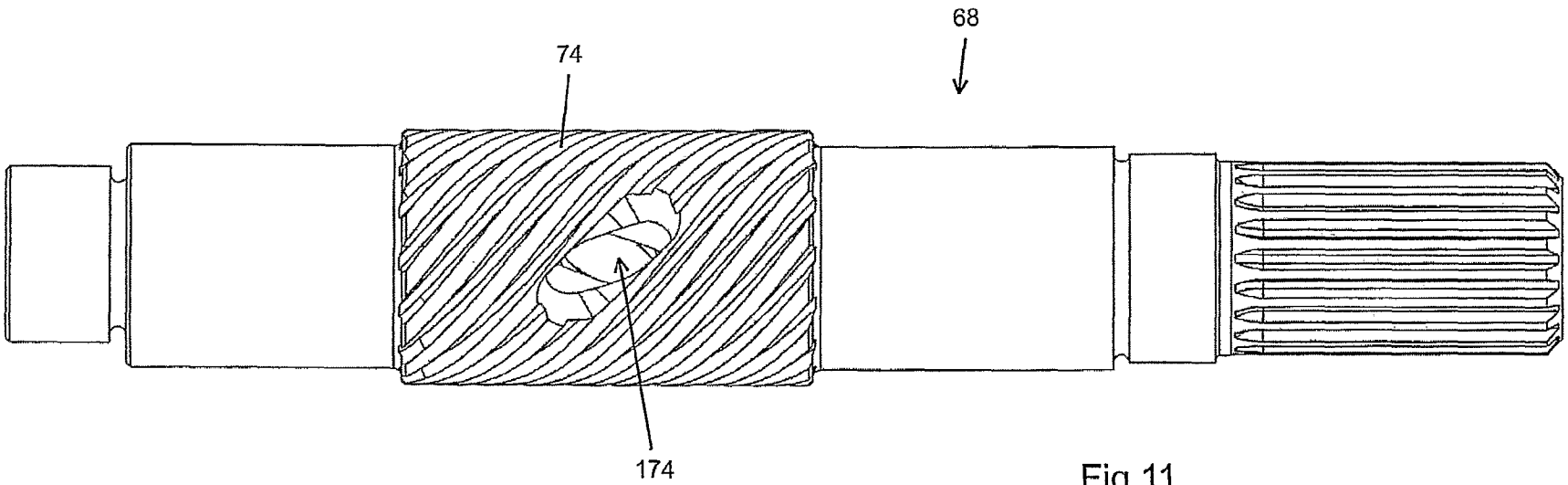
FIG. 11 is an elevation of a transverse shaft of the clutch of FIG. 8.
Figure 12:
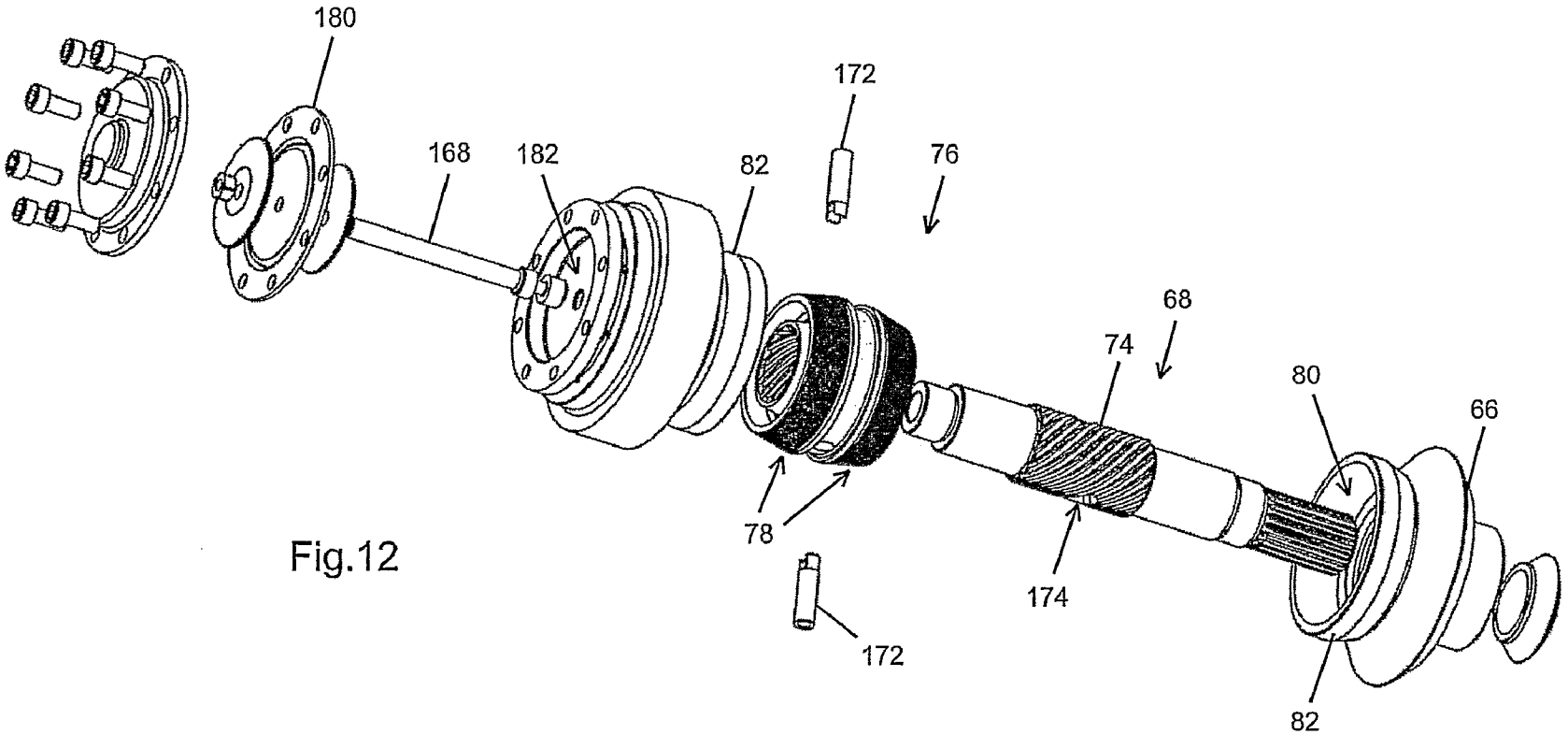
FIG. 12 is an exploded view of the clutch of FIG. 8.

A gear set and reversing clutch are shown at 46 in FIGS. 5 and 6 and are illustrated in more detail in FIG. 8, with elements of the clutch shown in more detail in FIGS. 10 to 12. The gear set and reversing clutch 46 are inside the housing 44. In FIG. 8 the seal of the bearing and seal 42 is shown. The bearing is above the seal but has not been illustrated.

An input shaft 48 has an array of splines (not shown) which enables it to be secured to the crank shaft (not shown) of the motor 12. The shaft 48 rotates in bearings 52 and 54 which are mounted in a bearing sleeve 56 which is bolted to the housing 44. A nut 58 secures the bearings 52,54 to the shaft 48 and a shaft seal is shown at 60. The sleeve 56 is externally splined and the arm 20 is connected to this.

The housing 44 comprises two outer shells 44.1, 44.2 of semi-cylindrical form and a centre part 44.3.

A first bevel pinion 62 is integral with the input shaft 48. A first bevel gear 64 and a second bevel gear 66 are supported coaxially on a first transverse shaft 68, with the first and second bevel gears 64,66 meshing with the first bevel pinion 62 on opposing sides. The first and second bevel gears 64,66 are supported on the first transverse shaft 68 on bearings 70 and it is to be understood that the first and second bevel gears will counter rotate, irrespective of the motion of the first transverse shaft. External bearings 72 are provided for mounting the first and second bevel gears 64,66 in the centre part 44.3 of the housing assembly 44.

The first transverse shaft 68 has helical splines 74 defined along its centre portion, the first transverse shaft passing through a sleeve-like clutch element 76. The clutch element 76 has complemental internal helical splines. The clutch element 76 has external, conical clutch surfaces 78, which cooperate with complemental internal conical clutch surfaces 80 defined in protuberances 82 of the first and second bevel gears 64,66, respectively.

The clutch element 76 can slide helically on the helical splines of the first transverse shaft 68, so that one of its clutch surfaces 78 engages the corresponding clutch surface 80 of either the first bevel gear 64 or the second bevel gear 66. Once engaged, the clutch element 76, by virtue of the interaction between the helical splines, pulls itself into the engaged position.

The clutch assembly is thus configured to connect the first bevel gear 64 to the first transverse shaft 68 via the clutch element 76 in a reverse condition, to connect the second bevel gear 66 to the first transverse shaft 68 in a forward condition and to connect neither the first nor the second bevel gear to the first transverse shaft, in a neutral condition, or vice versa.

A helical pinion 84 is keyed onto the first transverse shaft 68 and rotates in bearings 86. The pinion 84 meshes with a similarly mounted helical gear 88 which is keyed to a second transverse shaft 90. A second bevel pinion 92 is secured to the second transverse shaft 90 and meshes with a third bevel gear 94 forming part of an output shaft 96, which rotates in bearings 98 that are mounted in a bearing housing 100. The bearing housing 100 is within a pivot structure that is designated 146. A circlip 148 holds the housing 104 in the structure 146.

The output shaft 96 defines internal splines, which allows it to be connected to an externally splined inclined shaft 106 with a bevel pinion 110 at its lower end, that meshes with the gear 26 to drive the propeller 36.

It will be noted in FIG. 8 that the left hand side of the housing 44 is configured to receive another set of a helical pinion and gear. For a boat with two stern drives, it is advantageous for one stern drive to have its gear set on the left of the housing 44 and for the other stern drive to have its gear set on the right of its housing 44.

Referring now to FIGS. 10 to 12, details of the clutch assembly 102, forming part of the gear set and reversing clutch 46, includes a selector rod 168 that is coaxially slidable within a central passage 170 that is defined inside the first transverse shaft 68, from its end opposite from the end driving the pinion 84, i.e. from the left hand side in the drawings.

Two selector pins 172 extend transversely in diametrically opposing directions from the selector rod 168, close to its right hand end. The selector pins 172 are in the form of hollow pins and each have a protuberance that is slidably received in a circumferential slot in the selector rod 168. In this embodiment, the selector rod 168 can rotate relative to the selector pins 172.

In an alternative embodiment of the invention, instead of having a protuberance that slides in a slot defined in the selector rod 168, the selector pins 172 could be in the form of a single pin that extends through a transverse aperture in the selector rod. In this embodiment, the selector rod 168 and selector pins 172 rotate together.

Two diametrically opposed slots 174 are defined in the first transverse shaft 68 that extend from the central passage 170 to the outer surface of the shaft in the region of its helical splines 74. Each slot 174 has a width generally equal to the diameter of the selector pins 172 and is generally aligned with the helical splines 74.

Two internal recesses in the form of radial apertures 176 are defined in the clutch element 76 and are diametrically opposed and coaxial. The diameter of each of the apertures 176 is generally equal to the outer diameter of the selector pins 172.

The selector pins 172 extend from the selector rod 168 through the slots 174 into the apertures 176, where they fit snugly. Accordingly, if the selector rod 168 slides axially within the central passage, the selector pins 172 slide in the slots 174 and move the clutch element 76 axially. It would be clear to those skilled in the art that the movements of the selector pins 172 and clutch element 76 relative to the first transverse shaft, are not purely axial, but helical, since the selector pins slide in the slots 174 and the clutch element slides on the helical splines 74. The helical movement of the clutch element 76 allows its clutch surfaces 78 to engage and disengage the clutch surfaces 80 as described above.

The selector pins 172 are held captive in their positions by retaining elements (not shown) such as circlips in the outer ends of the apertures 176 or a retaining spring that extends around the circumference of the clutch element, in a circumferential groove 178.

The clutch 102 can be actuated in a number of ways, to impart axial movement to the selector rod 168. However, in the illustrated, preferred embodiment of the invention, the clutch includes a diaphragm 180 housed in a chamber 182 in which it can be displaced to the left or the right by applying hydraulic pressure within the chamber on either side of the diaphragm. The diaphragm 180 is connected to the selector rod 168 in a transverse arrangement and it follows that displacement of the diaphragm causes axial displacement the selector rod and thus operates the clutch as described above.

In am embodiment where the selector pins 172 extend through the selector rod 168 and the selector pins and selector rod thus rotate with the first transverse shaft 68, the selector rod can be connected to the diaphragm 180 via bearings, to slide rotatably within this attachment.

The use of hydraulic actuation and components extending from the diaphragm 180 to the clutch element 76 via the central passage 170 and the slots 174, allows the clutch actuation mechanism to be very compact, which is essential, since it forms part of the gear set and clutch 46 that has to be housed inside the housing 44, which in turn must be able to rotate as part of the steering action of the stern drive 10.

Figure 7:
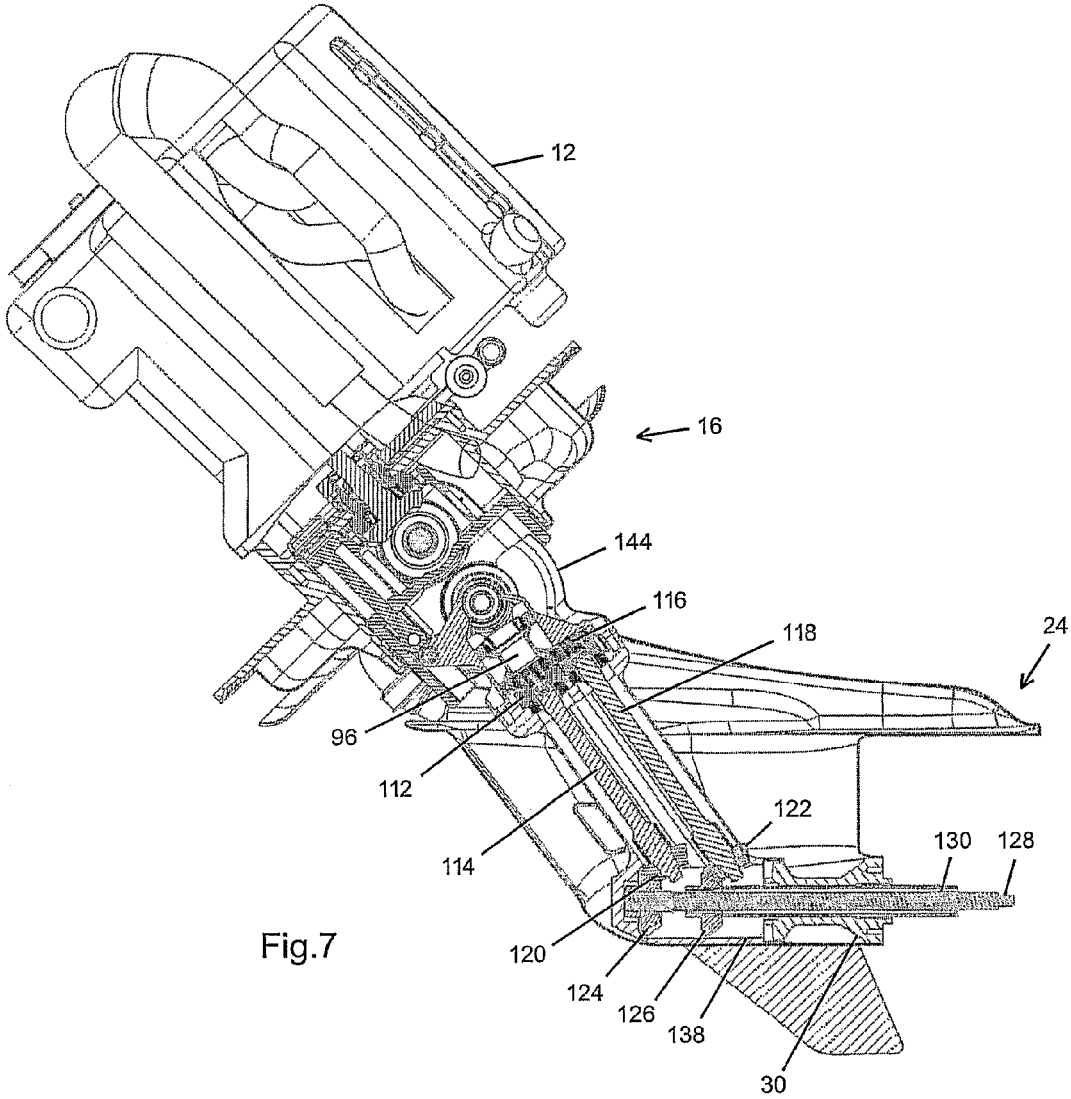
FIG. 7 is a section similar to that of FIG. 5 but showing a drive with twin output shafts.

The stern drive of FIG. 7 differs from that of FIGS. 1 to 6 in that the shaft 96 drives a pinion 112 which is at the upper end of a first inclined output shaft 114. The pinion 112 meshes with a gear 116 at the upper end of a second inclined shaft 118. The shafts 114, 118 have bevel pinions 120, 122 at the lower ends thereof. These bevel pinions mesh with further bevel gears 124, 126 on two contra-rotating propeller shafts 128, 130.

Figure 9:
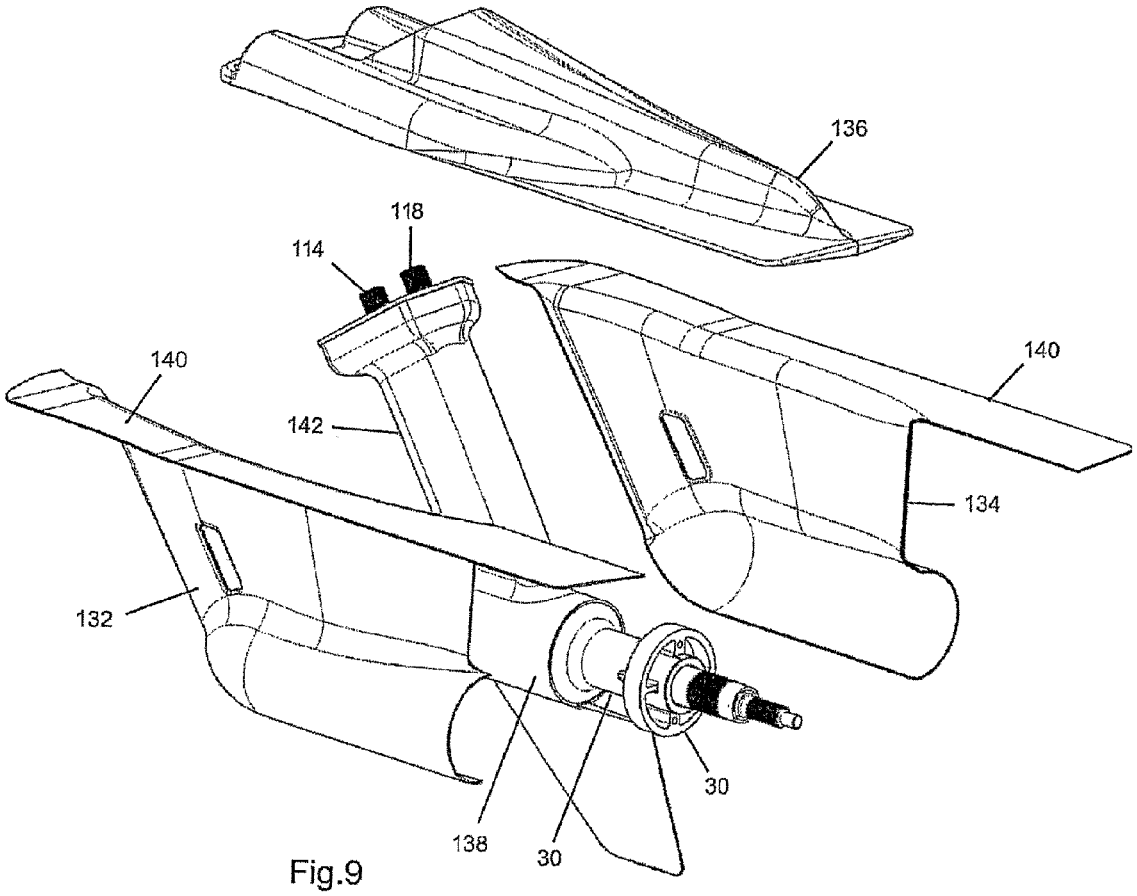
FIG. 9 illustrates the components of the fairing

The fairing 24 (see particularly FIG. 9) comprises two side sections 132, 134 and an upper section 136. The lower parts of the sections 132, 134 are generally semi-cylindrical and receive the propeller shaft 28 (or propeller shafts 128, 130). More specifically, the sleeve 30 is part of a tube 138 which is closed at its front end (see FIGS. 5, 6 and 7) and houses the bearing 34. The two semi-cylindrical parts of the sections 132, 134 house the tube 138.

The sections 132, 134 have horizontal webs 140 at their upper ends, these being secured to the section 136 during fabrication of the fairing.

The inclined shaft 106 (or the inclined shafts 114, 118) are within an inclined elongate casing 142 which is clamped between the sections 132, 134 during fabrication.

Referring to FIGS. 1 to 8, the structure 146 has two opposing cylindrical ends 150, each of which extends around a cylindrical protuberance 152 of its corresponding part of the housing 44.2 and 44.3 with bearings 154 between the cylindrical ends and protuberances, all co-axial with the shaft 90. Thus the pivot structure 146 can rotate about the axis of the shaft 90 carrying the housing 100 and shaft 96 with it. During such movement the gear 94 "rolls around" the pinion 92.

The casing 142 is secured by bolts (not shown) to the lower end of the structure 146. A shell 144 which is purely aesthetic is provided to conceal the internal structure.

An arm 158 forming part of the pivot structure 146 is connected by a link 160 to the rod 162 of a ram 164. The cylinder 166 of the ram 164 is part of the housing 44.

There are two further rams (not shown) parallel to the ram 164. These rams are of shorter stroke than the ram 164. All three rams are used to displace the fairing 24 for trimming purposes, the force required being significant in view of the thrust exerted on the fairing by the propeller 36. During lifting of the fairing 24 for stowage purposes, all three rams are operated. Two, however, reach the end of their travel before stowage is completed, and the ram 164 is effective to finalize such lifting.

If reference is made to FIG. 6 it will be noted that the link 160 is at right angles to the rod 162. Thus no amount of downward force exerted on the fairing 24 can push the rod 162 back into the cylinder 166.

In FIG. 5 the rod 162 is shown fully retracted into the cylinder 166 and the fairing 24 is thus in its lowered position. In FIG. 6 the rod 162 is fully extended and the fairing 24 is thus raised.

The fairing 24 thus moves between its raised and lowered positions by rotating about an axis which is the axis of the shaft 90.

Figure 4:
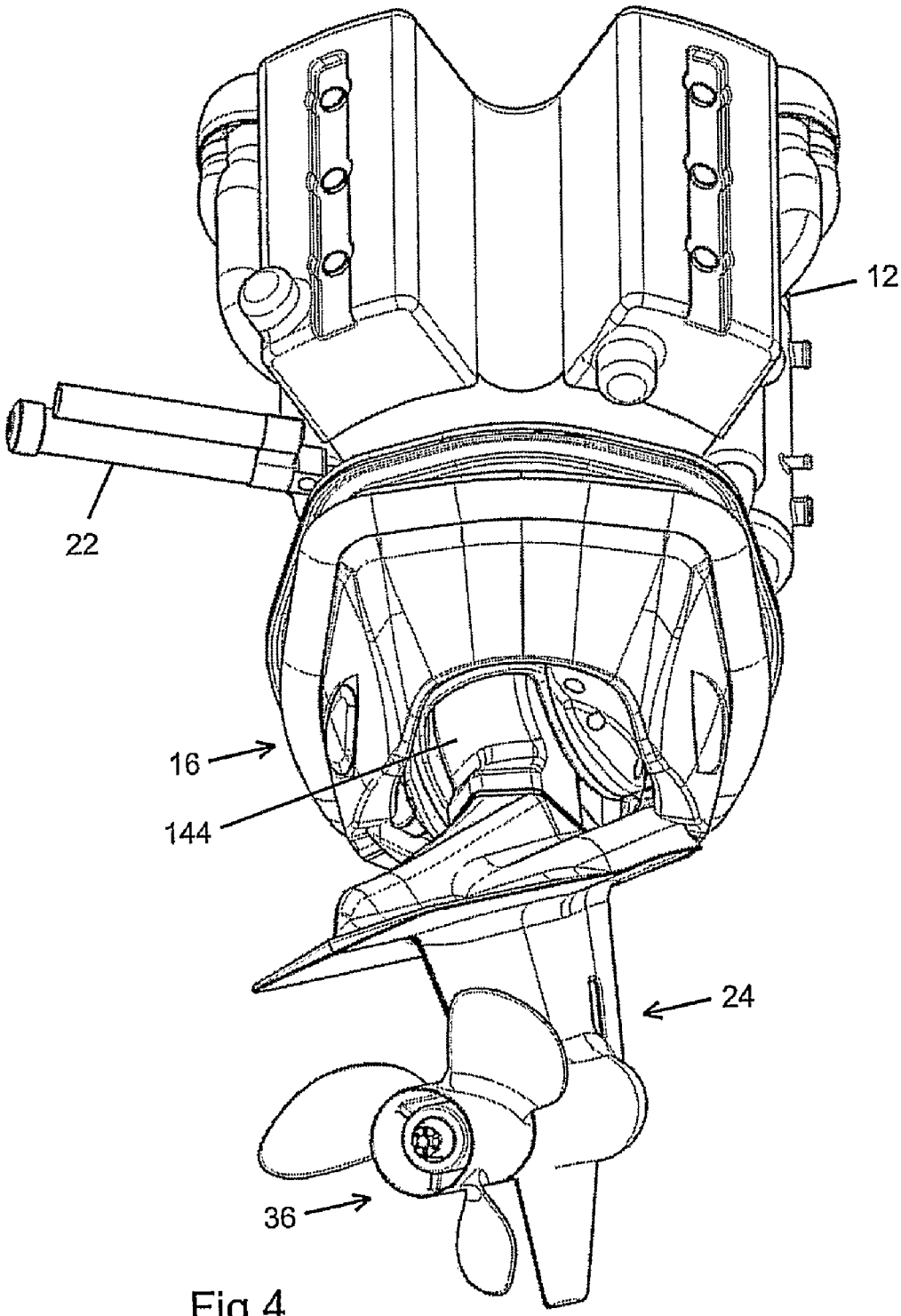
FIG. 4 is a rear view similar to that of FIG. 3 but showing the stern drive in the position it adopts during a port turn.

For steering purposes the housing 44, the entire gear set and reversing clutch 46 shown in FIG. 8, the structure 146, the casing 142 bolted to the structure 146 and the fairing 24 all rotate about the axis of the shaft 48 when the steering arm pushes or pulls on the housing 44 via the sleeve 56. In FIG. 4 the fairing is shown displaced to the position it occupies during a turn to port.

The invention claimed is:

1. A stern drive which comprises: an outer structure that is attachable to the stern of a boat; a housing supported in the outer structure; a gear set and reversing clutch inside the housing, said gear set including a pinion that is rotatable about a transverse axis; and an output shaft that extends downwardly within a fairing; wherein the housing is rotatable within the outer structure for steering purposes and the fairing and output shaft are rotatable about the transverse axis of said pinion thereby to permit raising, lowering and trimming of the fairing.

2. A stern drive as claimed in claim 1 wherein the axis of rotation of the housing relative to the outer structure, extends at an inclined angle.

3. A stern drive as claimed in claim 1, wherein said gear set and reversing clutch comprises: a first bevel pinion, connectable to a motor; first and second bevel gears that mesh with the bevel pinion on diametrically opposed sides of the bevel pinion and that are coaxial, each of the bevel gears defining a conical clutch face; a first transverse shaft passing coaxially through the bevel gears; a clutch element disposed on the first transverse shaft between the bevel gears, said clutch element defining two conical surfaces, each of which is complemental to the clutch face one of the bevel gears; a helical pinion on said first transverse shaft; a helical gear meshing with said helical pinion and carried by a second transverse shaft; and a second bevel pinion carried by the second transverse shaft and meshing with a third bevel gear carried by said output shaft, said fairing rotating about the axis of the second transverse shaft.

4. A stern drive as claimed in claim 3, wherein the output shaft is in an elongate casing which extends upwardly from said fairing and which is itself extended by a pivot structure to which said rod is connected.

5. A stern drive as claimed in claim 4, wherein the pivot structure is mounted on said second transverse shaft and rotates about it during lifting and lowering of the fairing and during trimming.

6. A stern drive as claimed in claim 3, wherein the first transverse shaft defines helical splines with which the clutch element is in engagement, the first transverse shaft defines a central passage that extends axially form at least one of its ends and defines at least one internal recess that extends in a radial direction, wherein the stern drive further includes a selector rod, disposed coaxially within the central passage of the first transverse shaft and being axially slidable within the central passage and at least one selector pin extending transversely form the selector rod, at least one slot being defined in the first transverse shaft, extending from the central passage to the outside of the shaft and having an orientation that is generally aligned with the helical splines of the shaft, the selector pin extending from the selector rod, through the slot and into the internal recess defined in the clutch element.

7. A stern drive as claimed in claim 1, wherein the fairing is displaced by a ram the cylinder of which forms part of said housing and the rod of which is connected to a structure which forms an extension of said fairing.

8. A stern drive as claimed in claim 1, wherein said output shaft drives a pinion which meshes with a gear on a further output shaft that is parallel to the first mentioned output shaft, the output shafts driving co-axial propeller shafts, the arrangement being such that the output shafts rotate in opposite directions and the propeller shafts also contra-rotate.

9. A stern drive as claimed in claim 8, wherein the stern drive includes a third output shaft, driven from the pinion.

10. A stern drive as claimed in claim 1, wherein said fairing comprises a pair of side sections which are attached together, and a top section which is attached to the side sections.

11. A stern drive including a gear set and reversing clutch comprising: a bevel pinion, connectable to an input shaft; first and second bevel gears that mesh with the bevel pinion on diametrically opposed sides of the bevel pinion and that are coaxial, each of the bevel gears defining a conical clutch face; a transverse shaft passing coaxially through the bevel gears, said transverse shaft defining helical splines and a central passage that extends axially form at least one of its ends; and a clutch element disposed on the transverse shaft between the bevel gears in engagement with the helical splines, said clutch element defining at least one internal recess, that extends in a radial direction, and said clutch element defining two conical surfaces, each of which is complemental to the clutch face one of the bevel gears; wherein the reversing clutch includes a selector rod, disposed coaxially within the central passage of the transverse shaft and being axially slidable within the central passage; and at least one selector pin, extending transversely form the selector rod; at least one slot being defined in the transverse shaft, extending from the central passage to the outside of the shaft and having an orientation that is generally aligned with the helical splines of the shaft, the selector pin extending from the selector rod, through the slot, into the internal recess defined in the clutch element.

12. A stern drive as claimed in claim 11, wherein the reversing clutch includes two selector pins extending in diametrically opposing directions from the selector rod, each passing through a separate slot and into a separate internal recess of the clutch element.

13. A stern drive as claimed in claim 12, wherein each internal recess in the clutch element extends to an outer circumference of the clutch element and each selector pin is held captive within its internal recess, by a retaining element.

14. A stern drive as claimed in claim 11, wherein the clutch includes a diaphragm, connected to a plunger which is configured to effect axial displacement of the selector rod.

15. A stern drive as claimed in claim 14, wherein the diaphragm is disposed adjacent the end of the transverse shaft from which the central passage extends.

16. Propulsion apparatus for a boat having a rearwardly and upwardly inclined transom, comprising:

a motor operative to selectively generate rotational power about an output axis;

mounting structure for transversely securing said motor to an inboard side portion of the transom in a manner such that said output axis extends transversely through the transom; and a stern drive unit positionable to extend rearwardly from the transom and comprising:

an input shaft connectable to said motor to receive rotational power therefrom, an output shaft structure spaced apart from said input shaft, first and second parallel intermediate shafts interposed between said input shaft and said output shaft structure and extending transversely thereto, a gearing system rotationally coupling said input shaft to said first intermediate shaft, said first intermediate shaft to said second intermediate shaft, and said second intermediate shaft to said output shaft structure, a fairing having a lower end portion, and a propeller structure rotationally coupled to said lower end portion of said fairing, said output shaft structure extending through said fairing and being drivingly coupled to said propeller structure, said fairing and said output shaft structure being rotatable about the axis of said second intermediate shaft for raising/lowering/trimming purposes, and said fairing, said output shaft structure and said first and second intermediate shafts being rotatable about the axis of said input shaft for steering purposes.

17. Motor-drivable boat apparatus comprising:

a boat having a rearwardly and upwardly inclined transom; and boat propulsion apparatus comprising a motor transversely secured to an inboard side portion of said transom and operative to selectively generate rotational power about an output axis extending transversely through said transom, and a stern drive unit projecting rearwardly from said transom and comprising:

an input shaft connectable to said motor to receive rotational power therefrom, an output shaft structure spaced apart from said input shaft, first and second parallel intermediate shafts interposed between said input shaft and said output shaft structure and extending transversely thereto, a gearing system rotationally coupling said input shaft to said first intermediate shaft, said first intermediate shaft to said second intermediate shaft, and said second intermediate shaft to said output shaft structure, a fairing having a lower end portion, and a propeller structure rotationally coupled to said lower end portion of said fairing, said output shaft structure extending through said fairing and being drivingly coupled to said propeller structure, said fairing and said output shaft structure being rotatable about the axis of said second intermediate shaft for raising/lowering/trimming purposes, and said fairing, said output shaft structure and said first and second intermediate shafts being rotatable about the axis of said input shaft for steering purposes.

18. Propulsion apparatus for a boat having a rearwardly and upwardly inclined transom, comprising:

a motor operative to selectively generate rotational power about an output axis;

mounting structure for transversely securing said motor to an inboard side portion of the transom in a manner such that said output axis extends transversely through the transom; and a stern drive unit comprising:

a fairing positionable to extend rearwardly from the transom and having a lower end portion, a propeller structure rotationally coupled to said lower end portion of said fairing, and a drive train rotatably coupling said motor and said propeller structure, said drive train extending at an inclined angle from said transom and having a first portion drivably coupled to said motor, and a second portion extending through said fairing and being drivingly coupled to said propeller structure, said fairing and said second portion of said drive train being rotatable about said output axis and about a portion of said drive train around a generally horizontal axis transverse to said output axis.

19. The propulsion apparatus of claim 18 wherein:

said drive train couples said motor and said propeller structure without the use of any U-joints or constant velocity joints.

20. Motor-drivable boat apparatus comprising:

a boat having a rearwardly and upwardly inclined transom; and boat propulsion apparatus comprising a motor transversely secured to an inboard side portion of said transom and operative to selectively generate rotational power about an output axis extending transversely through said transom, and a stern drive unit comprising:

a fairing projecting rearwardly from the transom and having a lower end portion, a propeller structure rotationally coupled to said lower end portion of said fairing, and a drive train rotatably coupling said motor and said propeller structure, said drive train extending at an inclined angle from said transom and having a first portion drivably coupled to said motor, and a second portion extending through said fairing and being drivingly coupled to said propeller structure, said fairing and said second portion of said drive train being rotatable about said output axis and about a portion of said drive train around a generally horizontal axis transverse to said output axis.

21. The motor-driven boat apparatus of claim 20 wherein:

said drive train couples said motor and said propeller structure without the use of any U-joints or constant velocity joints.

* * * * *